US010251529B2

(12) United States Patent
Kim et al.

(10) Patent No.: US 10,251,529 B2
(45) Date of Patent: Apr. 9, 2019

(54) DISHWASHER

(71) Applicant: LG ELECTRONICS INC., Seoul (KR)

(72) Inventors: Seunghun Kim, Seoul (KR); Sangwoo Woo, Seoul (KR); Younghwan Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/323,906

(22) PCT Filed: Jul. 21, 2016

(86) PCT No.: PCT/KR2016/007960

§ 371 (c)(1),
(2) Date: Jan. 4, 2017

(87) PCT Pub. No.: WO2017/022985

PCT Pub. Date: Feb. 9, 2017

(65) Prior Publication Data

US 2017/0196432 A1 Jul. 13, 2017

(30) Foreign Application Priority Data

Aug. 3, 2015 (KR) ..... 10-2015-0109607

(51) Int. Cl.
*A47L 15/16* (2006.01)
*A47L 15/42* (2006.01)

(52) U.S. Cl.
CPC ..... *A47L 15/4234* (2013.01); *A47L 15/16* (2013.01); *A47L 15/4257* (2013.01); *A47L 15/4285* (2013.01); *A47L 15/4289* (2013.01)

(58) Field of Classification Search
CPC .. A47L 15/16; A47L 15/4234; A47L 15/4257; A47L 15/4285; A47L 15/4289
USPC ..... 134/56 D, 57 D, 58 D, 105, 106
See application file for complete search history.

(56) References Cited

U.S. PATENT DOCUMENTS

2008/0236636 A1* 10/2008 Pyo ..... A47L 15/4234 134/106
2009/0007942 A1 1/2009 Park
2009/0126766 A1* 5/2009 Ahn ..... A47L 15/4234 134/56 D
2009/0314316 A1 12/2009 Hall
2011/0155184 A1 6/2011 Kim et al.
2012/0279527 A1* 11/2012 Lee ..... A47L 15/0036 134/106

FOREIGN PATENT DOCUMENTS

CN 2220823 Y 2/1996
CN 101090663 A 12/2007
CN 101332075 A 12/2008
CN 103284675 A 9/2013
(Continued)

*Primary Examiner* — Levon J Shahinian
(74) *Attorney, Agent, or Firm* — Dentons US LLP

(57) ABSTRACT

A dishwasher is disclosed. The dishwasher includes a cabinet having an opening, a tub provided in the cabinet to accommodate objects for washing, a spray arm for spraying wash water to the objects, a sump for storing wash water, a door for opening and closing the opening, and a first steam nozzle provided at an inner surface of the door to spray steam to the objects.

16 Claims, 9 Drawing Sheets

(56) References Cited

FOREIGN PATENT DOCUMENTS

| | | | |
|---|---|---|---|
| DE | 202015002175 | U1 | 6/2015 |
| EP | 2079350 | A1 | 7/2009 |
| EP | 2510864 | A1 | 10/2012 |
| JP | 2003-265394 | A | 9/2003 |
| KR | 10-2006-0124273 | A | 12/2006 |
| KR | 10-2007-0099358 | A | 10/2007 |
| KR | 1020070099358 | A | 10/2007 |
| KR | 10-2010-0058875 | A | 6/2010 |
| KR | 10-2012-0116325 | A | 10/2012 |
| KR | 10-1356495 | B1 | 2/2014 |
| WO | 2006/129928 | A2 | 12/2006 |
| WO | 2008/120847 | A1 | 10/2008 |

* cited by examiner

[Fig. 1]
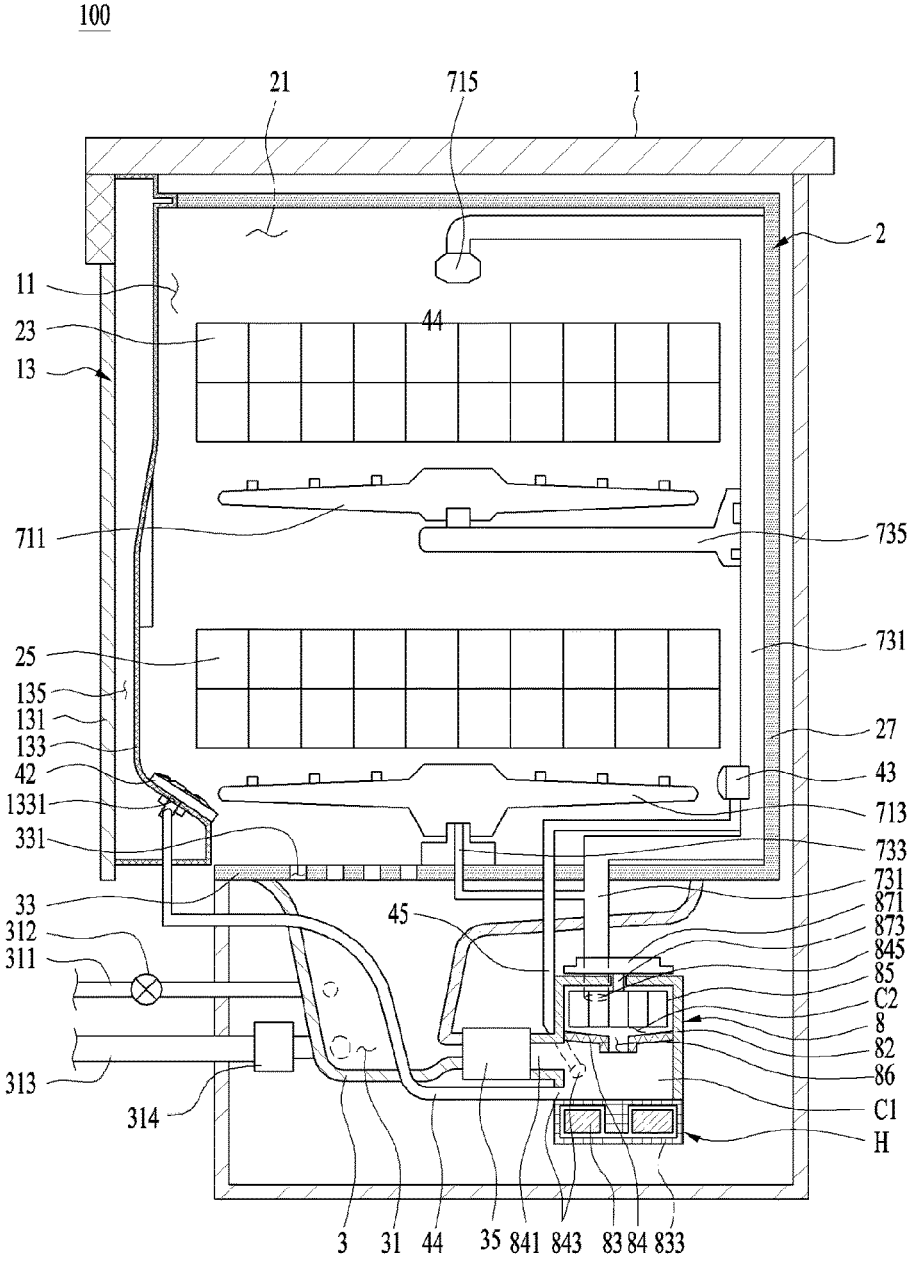

[Fig. 2]
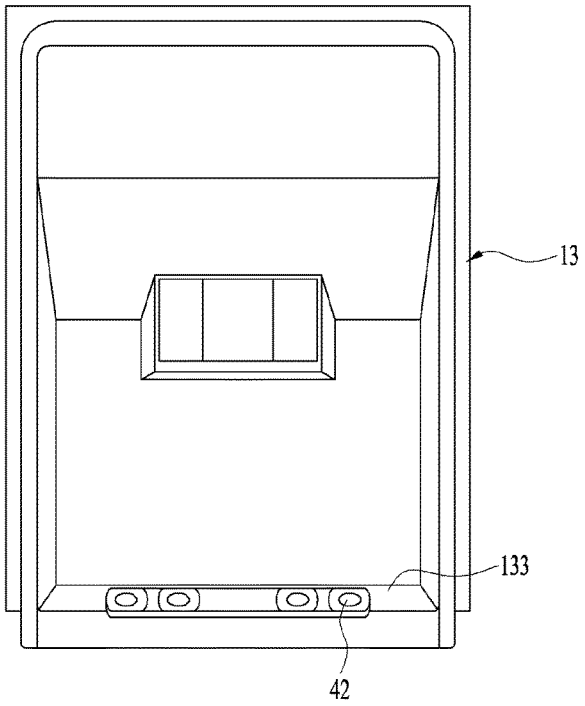
[Fig. 3]
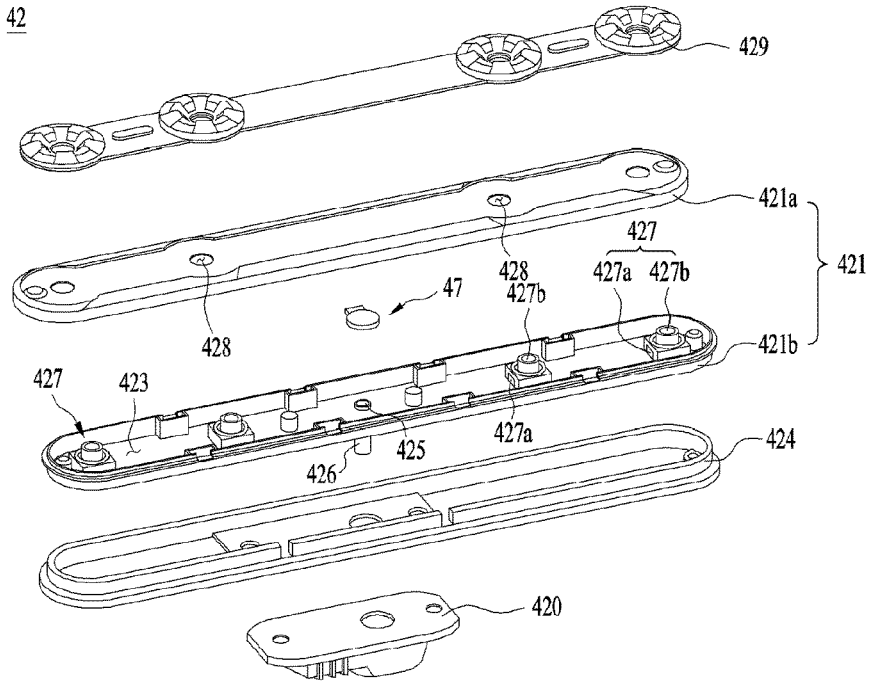

[Fig. 4]
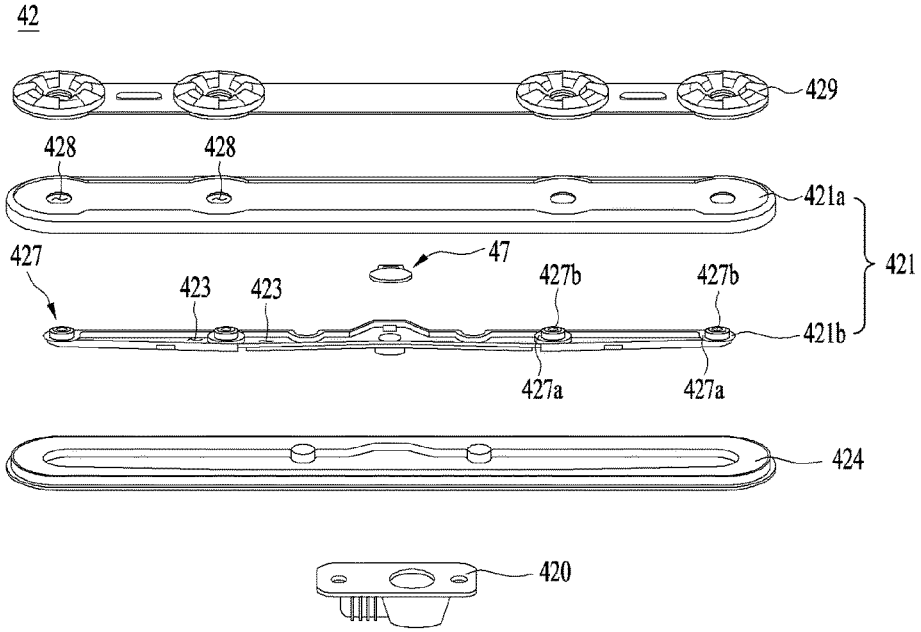
[Fig. 5]
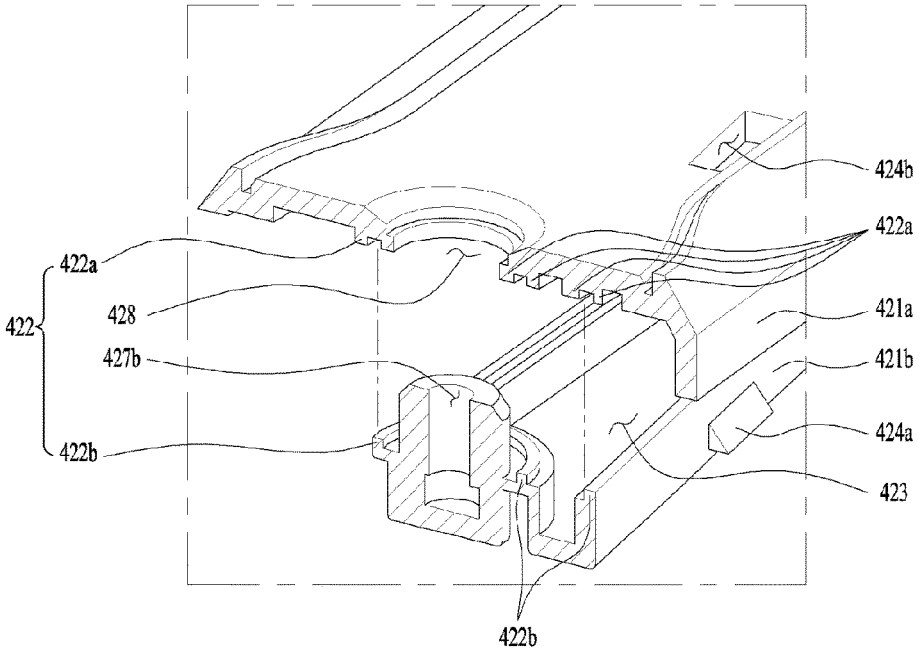

[Fig. 6]
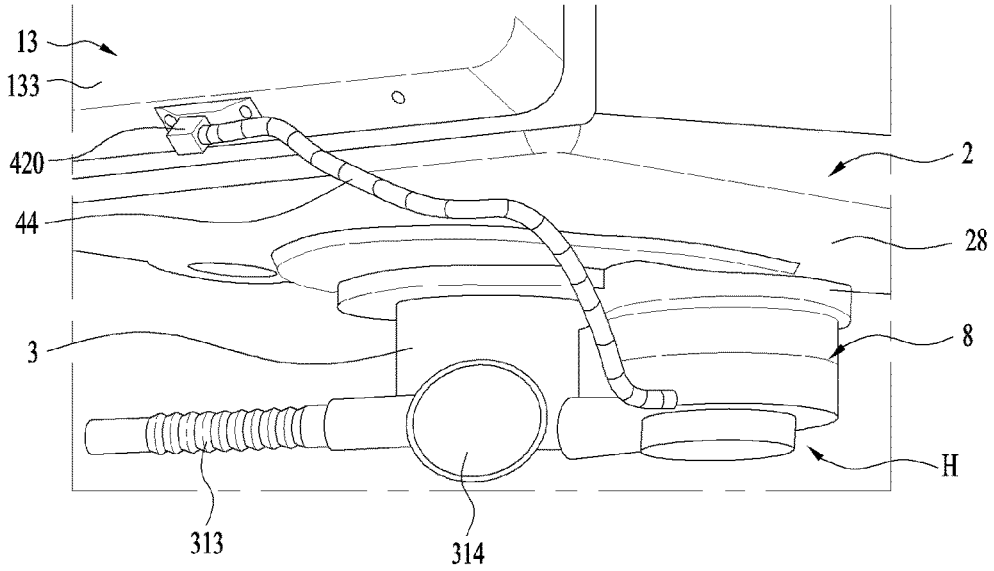

[Fig. 7]
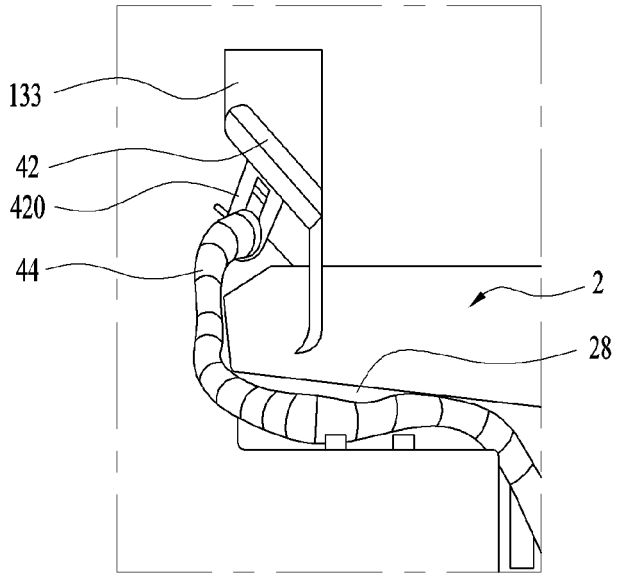
(a)
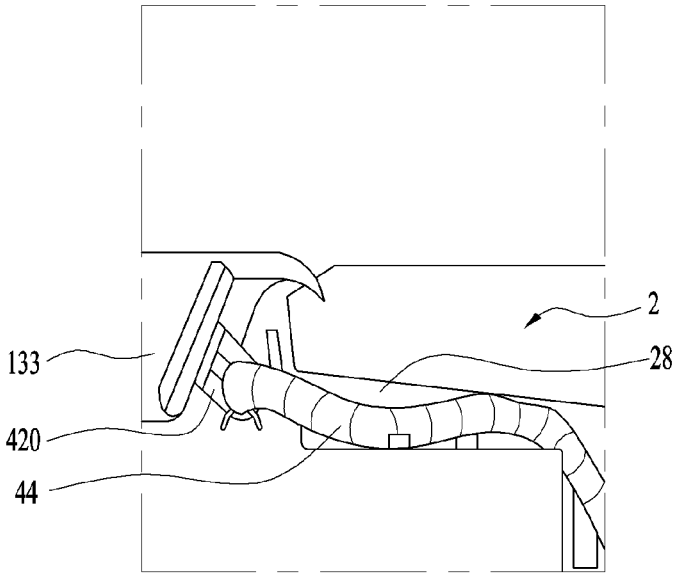
(b)

[Fig. 8]
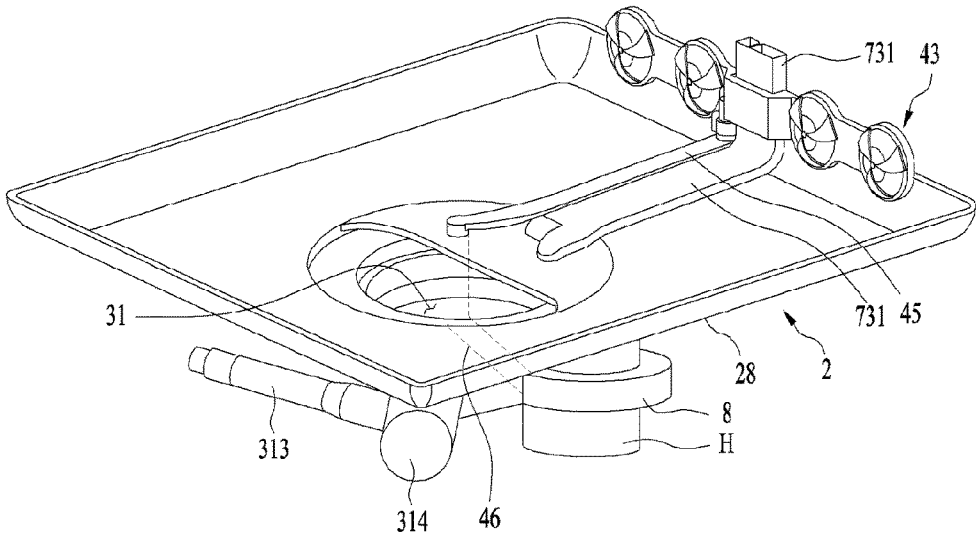
[Fig. 9]
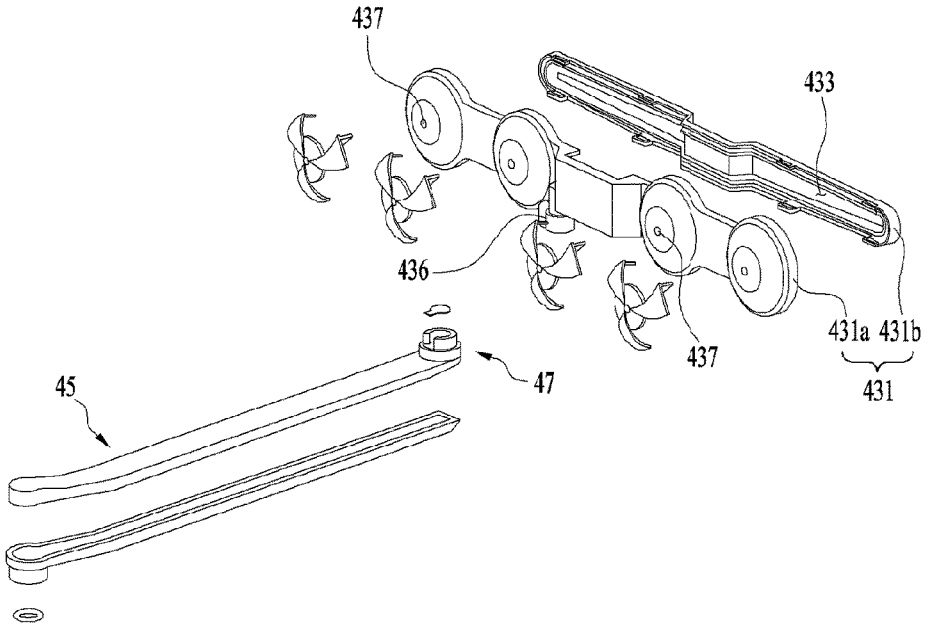

[Fig. 10]
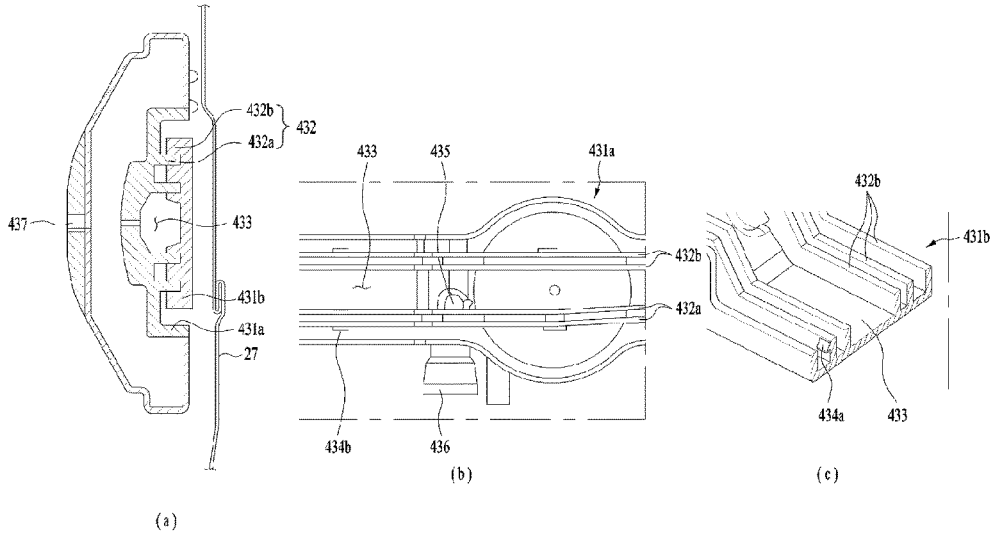
[Fig. 11]
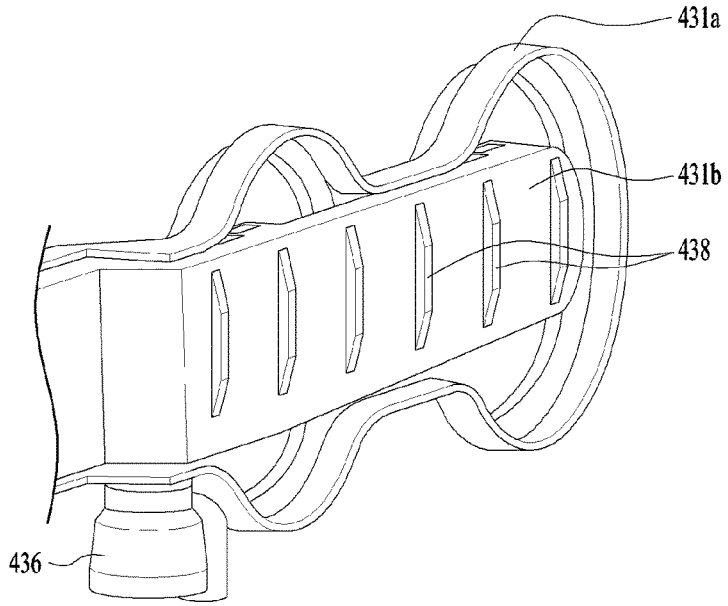

[Fig. 12]
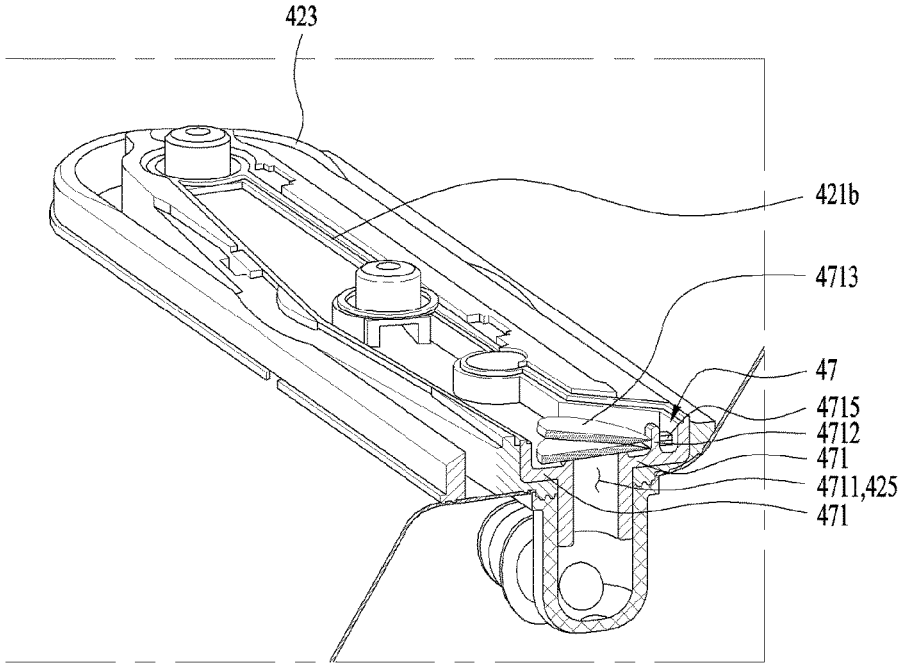
[Fig. 13]
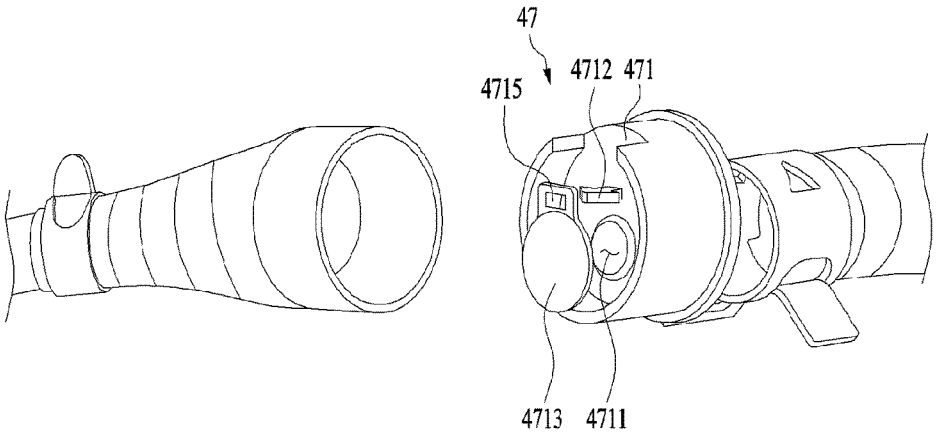

[Fig. 14]
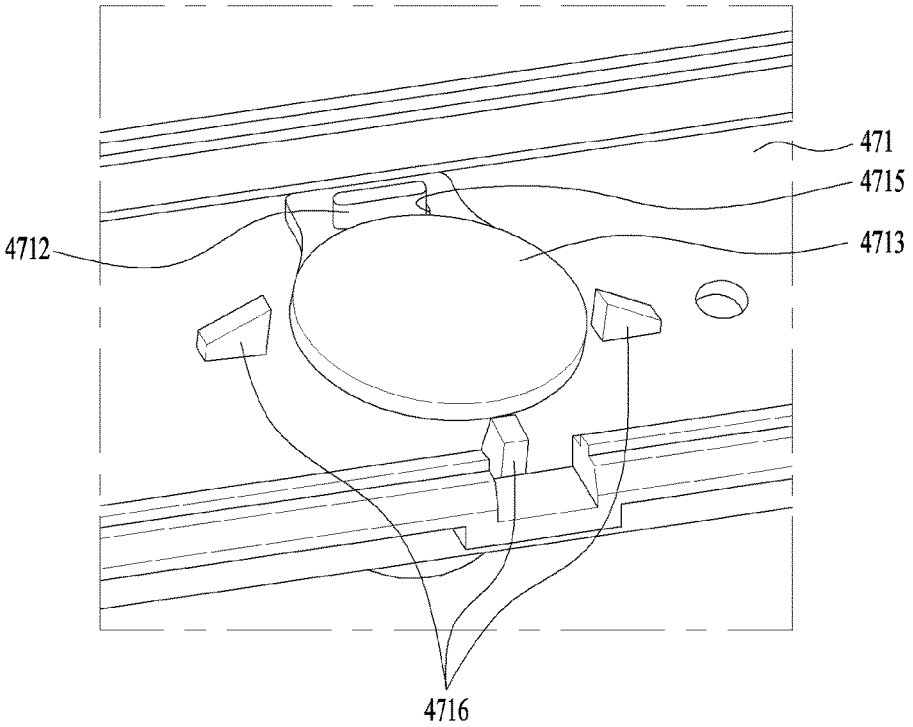
[Fig. 15]
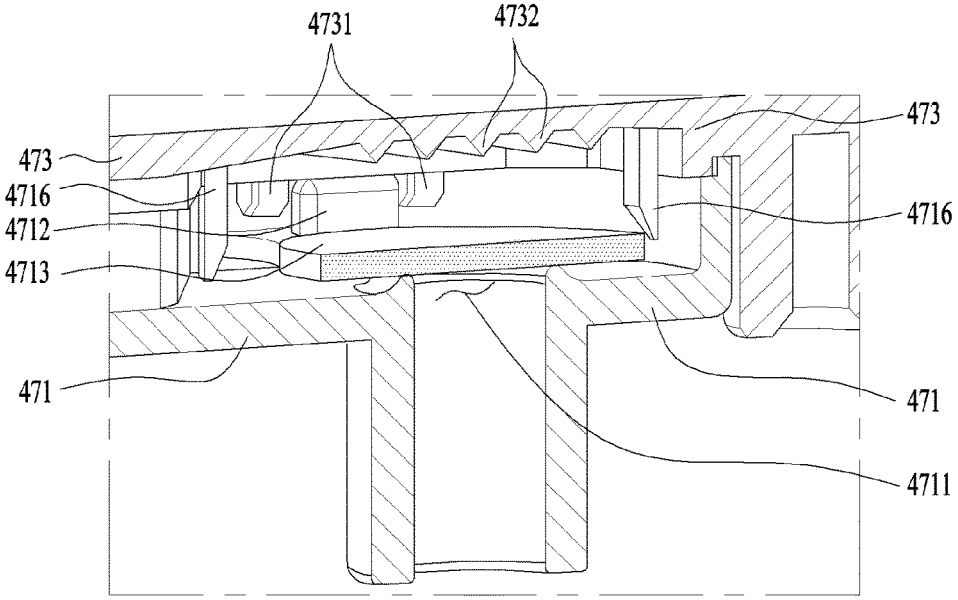

DISHWASHER

This application is a National Stage Application of International Application No. PCT/KR2016/007960, filed on Jul. 21, 2016, which claims the benefit of Korean Patent Application No. 10-2015-0109607, filed on Aug. 3, 2015, all of which are hereby incorporated by reference in their entirety for all purposes as if fully set forth herein.

TECHNICAL FIELD

The present invention relates to a dishwasher, and more particularly to a dishwasher including a steam nozzle provided at a door.

BACKGROUND ART

A dishwasher is an electric home appliance that sprays wash water onto objects to be washed in order to remove foreign matter from the objects.

A conventional dishwasher generally includes a tub that defines a washing space, a rack provided in the tub for receiving objects to be washed, a spray arm for spraying wash water to the rack, a sump for storing wash water, and a pump for supplying the wash water stored in the sump to the spray arm.

Meanwhile, some examples of the conventional dishwasher are configured to wash objects to be washed using heated wash water or to supply steam to objects to be washed in order to wash or sterilize the objects.

In the conventional dishwasher, the wash water stored in the sump is heated using a heater provided in the sump. In addition, the conventional dishwasher further includes a steam generator for generating steam.

The conventional dishwasher further includes a steam nozzle provided at the side of the tub for spraying steam into the tub and a steam hose connected between the steam nozzle and the steam generator.

In this case, however, the steam sprayed from the side of the tub cannot wet all surfaces of the objects.

In addition, the steam is supplied only to the objects placed in the opposite sides of the rack. As a result, the steam is not supplied to the objects placed in the middle part of the rack.

Furthermore, the steam is supplied only from the side of the tub. As a result, the temperature in the washing space, which is defined in the tub, is not uniform.

DISCLOSURE

Technical Problem

An object of the present invention devised to solve the problem lies on a dishwasher that is capable of spraying steam to objects to be washed from the front or the rear of a tub.

Another object of the present invention devised to solve the problem lies on a dishwasher that is capable of spraying steam from a door.

A further object of the present invention devised to solve the problem lies on a dishwasher that prevents back pressure from being generated in a steam nozzle connected to a sump or a pump.

Technical Solution

The object of the present invention can be achieved by providing a dishwasher including a cabinet having an opening, a tub provided in the cabinet to accommodate objects for washing, a spray arm for spraying wash water to the objects, a sump for storing wash water, a door for opening and closing the opening, and a first steam nozzle provided at an inner surface of the door to spray steam to the objects.

The first steam nozzle may be provided at the lower side of the door such that steam is uniformly sprayed throughout the tub.

The first steam nozzle may spray steam upward obliquely.

The dishwasher according to the present invention may further include a first steam path connected to the first steam nozzle to supply steam to the first steam nozzle. The first steam path may be located outside the tub, and may be connected to the first steam nozzle via the inner space of the door.

A hose may be provided as the first steam path. In this case, the hose may be made of rubber. When the door is opened or closed, therefore, torsional stress applied to the hose may be distributed.

A predetermined section of the first steam path may be provided parallel to a rotary shaft of the door.

The first steam nozzle may include a nozzle housing having a steam accommodating part for temporarily storing steam therein, an accommodating part inlet provided in the nozzle housing to supply steam to the steam accommodating part, and a plurality of accommodating part outlets provided in the nozzle housing to spray the steam stored in the steam accommodating part to the objects.

A sectional area of the steam accommodating part gradually decreases as the steam accommodating part becomes more distant from the accommodating part inlet.

The steam source may be variously configured. In one example, the first steam path may receive steam from a steam generator provided under the tub. In another example, a sump heater may be provided in the sump, and the first steam path may receive steam from the sump.

In a further example, the dishwasher may further include a pump for supplying the wash water stored in the sump to the spray arm. The pump may include a pump heater, and the first steam path may receive steam from the pump.

Meanwhile, steam may be sprayed from the rear of the tub as well as the front of the door such that the steam is supplied throughout the tub.

The dishwasher according to the present invention may further include a second steam nozzle provided at the rear surface of the tub to spray steam to the objects, a second steam path connected to the second steam nozzle to supply steam to the second steam nozzle, the second steam path penetrating the bottom of the tub, and a second connection path connecting the second steam path to a steam source.

The length of the second steam path may be greater than the length of the second connection path.

The second steam nozzle may be spaced apart from the rear surface of the tub. Consequently, it is possible to prevent foreign matter from accumulating between the second steam nozzle and the rear of the tub.

The second steam nozzle may include a foreign matter blocking rib for maintaining the distance between the second steam nozzle and the rear of the tub at a predetermined distance or more. Consequently, the distance between the second steam nozzle and the rear surface of the tub may be maintained despite vibration of the tub.

The dishwasher according to the present invention may further include a back pressure prevention unit for preventing external air from being introduced into the pump.

The back pressure prevention unit may include a check valve provided in the steam nozzle or in the steam path.

The check valve may include a first partition wall having a steam path hole, through which steam is discharged, a back pressure prevention plate for opening and closing the steam path hole, a prevention plate ring formed at one side of the back pressure prevention plate, and a fixing rib provided at the first partition wall. The fixing rib is coupled to the prevention plate ring to limit the movement of the back pressure prevention plate.

The check valve may further include separation prevention ribs, provided so as to be spaced apart from an outer circumferential surface of the back pressure prevention plate. The separation prevention ribs prevent the back pressure prevention plate from being separated in a leftward and rightward direction.

The check valve may further include stoppers provided above the back pressure prevention plate so as to be spaced apart from each other. The stoppers collide with the back pressure prevention plate, raised by the pressure of steam, to provide restoring force to the back pressure prevention plate.

The check valve may further include a contact prevention rib provided on a second partition wall, which is opposite the first partition wall. The contact prevention rib prevents the back pressure prevention plate from clinging to the second partition wall due to a hydroplaning phenomenon.

Advantageous Effects

The present invention has the effect of providing a dishwasher that is capable of spraying steam to objects to be washed from the front or the rear of a tub such that the steam is uniformly sprayed throughout the tub.

In addition, the present invention has the effect of providing a dishwasher including a steam nozzle provided at a door for spraying steam. Furthermore, the present invention has the effect of providing a dishwasher including a nozzle provided at the rear of a tub.

In addition, the present invention has the effect of providing a dishwasher including a path for supplying steam to a nozzle provided at a door, which is opened or closed, wherein the path is provided outside a tub such that the path is not visible, thereby improving visual safety.

In addition, the present invention has the effect of providing a dishwasher that prevents back pressure from being generated in a steam nozzle connected to a sump or a pump, thereby preventing noise from being generated in the pump.

DESCRIPTION OF DRAWINGS

The accompanying drawings, which are included to provide a further understanding of the invention, illustrate embodiments of the invention and together with the description serve to explain the principle of the invention.

In the drawings:

FIG. 1 is a view showing an example of a dishwasher according to the present invention;

FIG. 2 is a view showing the rear of a door provided in the dishwasher according to the present invention;

FIG. 3 is a view showing an example of a first steam nozzle provided in the dishwasher according to the present invention;

FIG. 4 is a view showing another example of the first steam nozzle provided in the dishwasher according to the present invention;

FIG. 5 is a sectional view showing another example of the first steam nozzle provided in the dishwasher according to the present invention;

FIG. 6 is a view showing a space under a tub and a space in the door;

FIG. 7 is a view showing the state of a first steam path in the state in which the door is closed and in the state in which the door is open in the dishwasher according to the present invention;

FIG. 8 is a view showing a second steam nozzle provided in the dishwasher according to the present invention;

FIG. 9 is an exploded perspective view showing the second steam nozzle provided in the dishwasher according to the present invention;

FIG. 10 is a sectional view and an internal perspective view showing the second steam nozzle provided in the dishwasher according to the present invention;

FIG. 11 is a view showing foreign matter blocking ribs provided in the second steam nozzle of the present invention;

FIG. 12 is a view showing a back pressure prevention unit for the steam nozzle provided in the dishwasher according to the present invention;

FIG. 13 is a view showing a back pressure prevention unit for the steam path provided in the dishwasher according to the present invention; and FIGS. 14 and 15 are views showing the back pressure prevention unit of the present invention.

BEST MODE

Reference will now be made in detail to the preferred embodiments of the present invention, examples of which are illustrated in the accompanying drawings.

All terms disclosed in this specification correspond to general terms understood by persons having ordinary skill in the art to which the present invention pertains unless the terms are specially defined. If the terms disclosed in this specification conflict with general terms, the terms may be understood on the basis of their meanings as used in this specification.

It should be noted herein that the construction and control method of a device which will hereinafter be described are given only for illustrative purposes, and that the protection scope of the invention is not limited thereto. Wherever possible, the same reference numbers will be used throughout the drawings to refer to the same or like parts.

The present invention relates to a dishwasher that is capable of spraying steam from the front or the rear of a tub. FIG. 1 is a view showing an example of a dishwasher according to the present invention.

As shown in FIG. 1, the dishwasher, denoted by reference numeral 100, may include a cabinet 1 having an opening 11, a tub 2 provided in the cabinet 1 to accommodate objects for washing, spray arms 711 and 713 for spraying wash water to the objects, a sump 3 for storing wash water, and a door 13 for opening and closing the opening 11.

The cabinet 1 defines the external appearance of the dishwasher. The opening 11 is formed in one side of the cabinet 1. The opening 11 communicates with the interior of the tub 2.

A washing space 21 is defined in the tub 2. Racks, in which the objects are received, may be provided in the washing space 21. The racks may include an upper rack 23 provided in the upper part of the tub 2 and a lower rack 25 provided below the upper rack 23.

The tub 2 is opened and closed by the door 13, which is provided at one surface of the cabinet 1 such that a user opens the door 13 and withdraws the upper rack 23 and the lower rack 25 from the tub 2.

In the case in which the racks include the upper rack 23 and the lower rack 25, the spray arms 711 and 713 may include an upper arm 711 for spraying wash water to the upper rack 23 from under the upper rack 23, and a lower arm 713 for spraying wash water to the lower rack 25 from under the lower rack 25. In addition, a top arm 715 for spraying wash water to the upper rack 23 from above the upper rack 23 may further be provided.

The wash water sprayed to the objects by the spray arms 711 and 713 may be collected in the sump 3.

The sump 3 includes a storage unit 31 provided under the tub 2 to store wash water. The storage unit 31 stores wash water containing foreign matter removed from the objects.

The sump 3 is provided at the top thereof with a sump cover 33, by which the sump 3 is partitioned from the tub 2. In this case, the sump cover 33 may be provided with a collection hole 331, through which the interior of the tub 2 communicates with the interior of the sump 3.

Meanwhile, the sump 3 is connected to a water source (not shown) through a water supply path 311. The water supply path 311 may be opened and closed by a water supply valve 312, which is controlled by a controller (not shown).

The wash water stored in the sump 3 is discharged out of the dishwasher through a drainage path 313 and a drainage pump 314.

The water stored in the sump 3 is supplied to the spray arms 711 and 713 via a pump 8 and a first supply path 731, a description of which will follow. The first supply path 731 is connected between the pump 8 and the top arm 715. The first supply path 731 extends into the tub 2 through the bottom of the tub 2. In addition, the first supply path 731 extends to the top of the tub 2 along one side of the tub 2.

Meanwhile, the upper arm 711 is connected to a third supply path 735, which diverges from the first supply path 731. In addition, the upper arm 711 is rotatably coupled to one end of the third supply path 735. The lower arm 713 is provided so as to be rotatable. The lower arm 713 is connected to a second supply path 733, which penetrates the bottom of the tub 2. The second supply path 733 is connected to the sump 3 or to a pump 8 such that wash water is supplied to the second supply path 733.

Meanwhile, the dishwasher 100 further includes a pump 8 for supplying wash water to the spray arms 711 and 713.

The pump 8 may include a body 82 fixed in the cabinet 1, a sump partition wall 84 for partitioning the inner space of the body 82 into a first chamber C1 and a second chamber C2, a communication hole 86 formed through the sump partition wall 84 for allowing the first chamber C1 and the second chamber C2 to communicate with each other therethrough, an introduction part 841 connected between the sump 3 and the first chamber C1, a wash water discharge part 845 connected between the second chamber C2 and the first supply path 731, an impeller 85 provided in the second chamber C2, and a heater assembly H provided in the bottom of the first chamber C1.

The pump 8 is connected to the sump 3 through a connection path 35. The connection path 35 is connected to the lower end of the side of the storage unit 31 of the sump 3 and to the introduction part 841 of the pump 8.

Since the heater assembly H defines the bottom of the first chamber C1, the pump 8 may simultaneously perform a function of heating wash water and a function of circulating wash water.

The heater assembly H may include a pump heater 83, which is exposed in the first chamber C1 such that the pump heater 83 directly contacts wash water. Alternatively, the heater assembly H may include a pump heater 83, which is provided in a heater housing 833. The heater housing 833 may define the bottom of the first chamber C1 such that the pump heater 83 does not directly contact wash water. Heat may be transferred to the heater housing 833 such that wash water is heated by the heater housing 833. In this case, the heater housing 833 may be made of a heat conductor, such as a metal, such that thermal energy can be effectively transferred to the wash water.

The impeller 85 moves wash water, introduced from the first chamber C1 into the second chamber C2 through the communication hole 86, to the wash water discharge part 845. The impeller 85 may be rotated by an impeller drive unit 87 provided outside the body 82.

The drive unit 87 may include a motor 871 provided at the top of the second chamber C2 and a rotary shaft 873 of the motor 871*m* which is connected to the impeller 85 through the pump 8.

FIG. 2 is a view showing the rear of the door provided in the dishwasher according to the present invention. FIG. 3 is a view showing an example of a first steam nozzle provided in the dishwasher according to the present invention. FIG. 4 is a view showing another example of the first steam nozzle provided in the dishwasher according to the present invention. FIG. 5 is a sectional view showing another example of the first steam nozzle provided in the dishwasher according to the present invention Hereinafter, a first steam nozzle 42 provided in the dishwasher according to the present invention will be described.

The dishwasher 100 according to the present invention may supply steam to the objects in order to improve washing efficiency.

In the conventional dishwasher, steam is sprayed only from the side of the tub. As a result, the steam is intensively sprayed to objects placed in opposite sides of the rack. That is, the steam is not uniformly sprayed throughout the tub. In addition, the temperature of the dishes is not uniform.

In order to solve the above problems, as shown in FIG. 2, the dishwasher according to the present invention may further include a first steam nozzle 42 provided at an inner surface of the door 13 to spray steam to the objects.

In this case, steam may be uniformly sprayed to the dishes in the washing space. That is, the steam may not be sprayed only to the objects placed in opposite sides of the racks, but may be sprayed to all of the objects placed in the racks.

Meanwhile, the first steam nozzle 42 may be provided at an inner surface of the door 13. Here, "an inner surface of the door 13" means the surface of the door 13 that faces the washing space 21 in the tub 2. In other words, on the assumption that the door 13 includes a front panel 131 defining the external appearance of the dishwasher 100, a rear panel 133 defining the inner surface of the door, and an inner space 135 defined between the front panel 131 and the rear panel 133, the first steam nozzle 42 may be provided at the rear panel 133 of the door 13.

Meanwhile, the first steam nozzle 42 may be provided at the lower side of the door 13. In this case, it is possible to use the property whereby steam rises. As a result, the steam may be uniformly supplied to the upper part of the washing space as well as the lower part of the washing space. Furthermore, it is possible to maximally increase the temperature of the objects.

In addition, the first steam nozzle 42 may spray steam upward obliquely. That is, the first steam nozzle 42 may spray steam to the objects placed in the upper rack 23 or the lower rack 25. Consequently, the first steam nozzle 42 may directly spray steam to the objects.

Referring to FIGS. 3 and 4, one example and another example of the first steam nozzle 42 may each include a first nozzle housing 421 having a first steam accommodating part 423 for temporarily storing steam therein, a first accommodating part inlet 425 provided in the first nozzle housing 421 to supply steam to the first steam accommodating part 423, and a plurality of first accommodating part outlets 427 provided in the first nozzle housing 421 to spray the steam stored in the first steam accommodating part 423 to the objects.

The first nozzle housing 421 may include a first lower nozzle housing 421*b*, in which the first accommodating part inlet 425 is provided, and a first upper nozzle housing 421*a* coupled to the upper end of the first lower nozzle housing 421*b*. Consequently, the first steam accommodating part 423 is defined between the first lower nozzle housing 421*b* and the first upper nozzle housing 421*a*.

The first accommodating part outlets 427 are provided in the first lower nozzle housing 421*b*. The first upper nozzle housing 421*a* is provided with first outlet through holes 428, through which the first accommodating part outlets 427 extend. Each of the first accommodating part outlets 427 includes a first inlet 427*a* communicating with the first steam accommodating part 423 and a first outlet 427*b* connected to the first inlet 427*a* for allowing steam to actually be discharged therethrough. That is, the first inlet 427*a* may communicate with the first steam accommodating part 423, and the first outlet 427*b* may protrude outward from the first nozzle housing 421.

The first nozzle housing 421 may further include a first nozzle insertion part 426 protruding outward therefrom. The first nozzle insertion part 426 may communicate with the first accommodating part inlet 425, and may supply steam, received from the outside, to the first steam nozzle 42.

The first upper nozzle housing 421*a* and the first lower nozzle housing 421*b* may be fastened to each other via a hook. A nozzle gasket 424 may further be provided between the first upper nozzle housing 421*a* and the first lower nozzle housing 421*b* in order to prevent steam from leaking out from between the first upper nozzle housing 421*a* and the first lower nozzle housing 421*b*.

The nozzle gasket 424 is made of rubber, and is manufactured by insert injection molding. The nozzle gasket 424 seals the gap in the first nozzle housing 421 to prevent the leakage of steam. In addition, the nozzle gasket 424 seals the gap between the inside of the door 13 and the first steam nozzle 42 to prevent foreign matter from accumulating between the door 13 and the first steam nozzle 42.

The nozzle gasket 424 may be configured to cover only the gap in the first nozzle housing 421. Alternatively, the nozzle gasket 424 may be configured to cover the entire surface of the first lower nozzle housing 421*b*.

The first nozzle housing 421 may extend in the leftward and rightward direction of the door. The first accommodating part outlets 427 may be provided in the first nozzle housing 421 so as to supply steam throughout the washing space.

Meanwhile, the first steam nozzle 42 may further include a first nozzle decorative part 429 provided outside the first nozzle housing 421. The first nozzle decorative part 429 may improve the aesthetic appearance of the first steam nozzle 42.

Meanwhile, referring to FIG. 4, the first steam accommodating part 423 may be configured such that the sectional area of the first steam accommodating part 423 gradually decreases as the first steam accommodating part 423 becomes more distant from the first accommodating part inlet 425. As the first steam accommodating part 423 becomes more distant from the first accommodating part inlet 425, the pressure of the steam in the first steam accommodating part 423 is lowered. As a result, the pressure of the steam discharged from the first accommodating part outlets 427 may be lowered. The first steam accommodating part 423 may be configured as described above in order to solve this problem.

That is, the first steam accommodating part 423 may be configured such that the sectional area of the first steam accommodating part 423 gradually decreases as the first steam accommodating part 423 becomes more distant from the first accommodating part inlet 425 such that the pressure of the steam discharged from the first accommodating part outlets 427 is uniform.

Referring to FIG. 5, the first nozzle housing 421 may include a plurality of ribs 422 for coupling the first upper nozzle housing 421*a* and the first lower nozzle housing 421*b* to each other in the sealed state. The ribs 422 include an upper rib 422*a* protruding downward from the first upper nozzle housing 421*a*, and a lower rib 422*b* protruding upward from the first lower nozzle housing 421*b*. Alternatively, two or more upper ribs 422*a* and two or more lower ribs 422*b* may be provided. The upper ribs 422*a* and the lower ribs 422*b* are coupled to each other to prevent steam from leaking out from the first steam accommodating part 423.

Meanwhile, a hook 424*a* and a hook hole 424*b* may be provided to couple the first upper nozzle housing 421*a* and the first lower nozzle housing 421*b* to each other. The hook 424*a* may be provided on the first lower nozzle housing 421*b*, and the hook hole 424*b* may be provided in the first upper nozzle housing 421*a*. The first lower nozzle housing 421*b* may be fastened to the first upper nozzle housing 421*a* by inserting the hook 424*a* into the hook hole 424*b*.

FIG. 6 is a view showing a space under the tub and a space in the door. FIG. 7 is a view showing the state of a first steam path in the state in which the door is closed and in the state in which the door is open in the dishwasher according to the present invention.

Hereinafter, a first steam path 44 provided in the dishwasher according to the present invention will be described with reference to FIG. 6.

In a general dishwasher, a steam path extending through one side of the tub is connected to the steam nozzle in the tub in order to provide steam to the steam nozzle, provided in the tub. In this case, a hose is provided as the steam path.

In the dishwasher according to the present invention, on the other hand, the first steam nozzle 42 is provided at the door 13. When the door 13 is opened and closed, the first steam path 44, connected to the first steam nozzle 42, continuously moves in the tub 2. As a result, the first steam path 44 may be separated from the first steam nozzle 42, or the hose, constituting the first steam path 44, may tear. Additionally, in the case in which the first steam path 44 is provided in the tub, the hose may be damaged due to the movement of the racks.

In order to solve the above problems, as shown in FIG. 6, the dishwasher according to the present invention is characterized in that the first steam path 44, which is connected to the first steam nozzle 42 to supply steam to the first steam nozzle 42, is located outside the tub 2. That is, the dishwasher according to the present invention is different from a conventional dishwasher, in which the steam path is connected to the steam nozzle in the tub.

Specifically, the first steam nozzle 42 is provided at one surface of the rear panel 133 of the door 13, and the first steam path 44 is provided at the other surface of the rear panel 133 of the door 13. The first steam nozzle 42 penetrates the rear panel 133 of the door 13 such that steam is supplied from the first steam path 44 to the first steam nozzle 42.

The first nozzle insertion part 426 of the first steam nozzle 42 is inserted through a steam nozzle insertion hole 1331 (see FIG. 1), provided in the rear panel 133, so as to protrude into the inner space 135 (see FIG. 1) of the door 13. As previously described, the nozzle gasket 424 is provided between the first nozzle housing 421 and the door 13 to prevent wash water from leaking out though the steam nozzle insertion hole 1331.

Meanwhile, the dishwasher according to the present invention may further include a steam guide 420 provided at an inner surface of the rear panel 133 of the door and connected to the first nozzle insertion part 426 for perpendicularly changing the direction of the steam path.

Referring back to FIG. 4, the steam guide 420 is formed in the shape of a '⌊'. One side of the steam guide 420 is connected to the first nozzle insertion part 426, which protrudes perpendicularly from the rear panel 133. The other side of the steam guide 420 is bent toward the left side or the right side the door 13, and is connected to the first steam path 44.

In this case, one end of the first steam path 44, which is connected to the rear panel 133 of the door 13, may be provided parallel to a rotary shaft of the door 13. When the door 13 is opened or closed, therefore, torsional stress, rather than bending stress, is applied to the first steam path 44, which is connected to the lower side of the tub 2. As a result, it is possible to prevent the first steam path 44 from being folded or bent, thereby preventing the first steam path 44 from tearing.

FIG. 7 shows another embodiment for preventing the first steam path 44 from being folded or bent. Referring to FIG. 7, the first steam path 44 may be fixed to the left side or the right side of the bottom of the tub 2. That is, the first steam path 44 may be mounted to the left side or the right side of the tub 2 under the tub 2. As a result, one end of the first steam path 44 may be connected to the rear panel 133 of the door 13 while being parallel to the rotary shaft of the door 13. When the door 13 is opened or closed, therefore, torsional stress, rather than bending stress, may be applied to one end of the first steam path 44, which is connected to the rear panel 133 of the tub 2.

Additionally, in the case in which the first steam path 44 is located at the left side or the right side of the tub 2 under the tub 2, the steam guide 420 may be located at one side opposite the other side at which the first steam path 44 is located on the basis of the horizontal middle of the door 13. In this case, the length of the end of the first steam path 44 that is located parallel to the rotary shaft of the door 13 may be further increased.

Meanwhile, a hose made of rubber or plastic may be provided as the first steam path 44 such that the first steam path 44 can withstand torsional stress that is generated when the door 13 is opened or closed.

Meanwhile, the dishwasher 100 according to the present invention may include various embodiments for supplying steam to the first steam path 44.

In an embodiment, an additional steam generator (not shown) may be provided under the tub 2, and the first steam path 44 may be connected to the steam generator (not shown) such that steam is supplied to the first steam nozzle 42.

In another embodiment, a sump heater (not shown) may be provided in the sump 3, and the first steam path 44 may be connected to one side of the sump 3 such that steam is supplied to the first steam nozzle 42.

In a further embodiment, steam may be supplied to the first steam path 44 using the pump heater 83 provided in the pump 8. In this case, the steam generated by the pump heater 83 may be supplied to one end of the first steam path 44, which is connected to the pump 8.

Specifically, since the heater assembly H is provided in the bottom of the first chamber C1, a predetermined amount of wash water is supplied into the first chamber C1, and then the pump heater 83 may be operated to generate steam. In this case, a steam discharge port 843 (see FIG. 1) for discharging the steam, generated in the first chamber C1, out of the first chamber C1 may be further provided. The steam discharge port 843 may be connected to the first steam path 44. The steam generated by the pump heater 83 of the pump 8 may be supplied to the first steam nozzle 42 via the first steam path 44.

FIG. 8 is a view showing a second steam nozzle provided in the dishwasher according to the present invention. FIG. 9 is an exploded perspective view showing the second steam nozzle provided in the dishwasher according to the present invention. FIG. 10 is a sectional view and an internal perspective view showing the second steam nozzle provided in the dishwasher according to the present invention. FIG. 11 is a view showing foreign matter blocking ribs provided in the second steam nozzle of the present invention.

Hereinafter, the structure in which steam is sprayed from the rear of the tub will be described.

Referring to FIG. 8, the dishwasher according to the present invention may include a second steam nozzle 43 provided at the rear surface of the tub 2 to spray steam to the objects, and a second steam path 45 for supplying steam to the second steam nozzle 43.

The second steam nozzle 43 may be separably fixed in the first supply path 731.

The second steam nozzle 43 may be provided at the rear surface 27 (see FIG. 1) of the tub 2. More specifically, the second steam nozzle 43 may be provided at the lower part of the rear surface 27 of the tub 2 (the lower part of the side of the tub). This is because steam is characterized in that it rises and because it is necessary to supply steam throughout the washing space. In addition, the second steam nozzle 43 may be inclined upward toward the objects. In this case, the second steam nozzle 43 may directly spray steam to the objects in order to effectively remove foreign matter from the objects.

Referring to FIGS. 9 and 10, the second steam nozzle 43 may have a structure similar to the structure of the first steam nozzle 42. Specifically, the second steam nozzle 43 may include a second nozzle housing 431 having a second steam accommodating part 433 for temporarily storing steam therein, a second accommodating part inlet 435 provided in the second nozzle housing 431 to supply steam to the second steam accommodating part 433, and a plurality of second accommodating part outlets 437 provided in the second nozzle housing 431 to spray the steam stored in the second steam accommodating part 433 to the objects.

The second nozzle housing 431 includes a second lower nozzle housing 431*b*, in which the second accommodating part inlet 435 is provided, and a second upper nozzle housing 431*a* coupled to the upper end of the second lower nozzle housing 431*b*. As a result, the second steam accommodating part 433 may be defined between the second lower nozzle housing 431*b* and the second upper nozzle housing 431*a*. In addition, the second accommodating part outlets 437 are provided in the second upper nozzle housing 431*a*.

The second nozzle housing 431 may further include a second nozzle insertion part 436 protruding outward. The second nozzle insertion part 436 may communicate with the second accommodating part inlet 435 to supply steam, received from the outside, to the second steam nozzle 43.

Meanwhile, a back pressure prevention unit for preventing external air from being introduced into the pump 8 may be provided between the second steam path 45 and the second nozzle insertion part 436. For example, a check valve 47 may be provided as the back pressure prevention unit. A detailed description of the back pressure prevention unit will follow.

As shown in FIG. 10, the second upper nozzle housing 431*a* and the second lower nozzle housing 431*b* may be fastened to each other using a hook 434*a* and a hook fastening part 434*b*. In this case, the hook 434*a* may be provided on the second lower nozzle housing 431*b*, and the hook fastening part 434*b* may be provided in the second upper nozzle housing 431*a*. In addition, the second nozzle housing 431 may include a plurality of steam leakage prevention ribs 432 for preventing steam from leaking out from between the second upper nozzle housing and the second lower nozzle housing.

The steam leakage prevention ribs 432 includes upper steam leakage prevention ribs 432*a* provided in the second upper nozzle housing 431*a*, and lower steam leakage prevention ribs 432*b* provided in the second lower nozzle housing 431*b*. The upper steam leakage prevention ribs 432*a* and the lower steam leakage prevention ribs 432*b* may be engaged with each other to prevent the leakage of steam. For example, in the case in which two upper steam leakage prevention ribs 432*a* are provided in the second upper nozzle housing 431*a*, three lower steam leakage prevention ribs 432*b* may be provided in the second lower nozzle housing 431*b*. In this case, the upper steam leakage prevention ribs 432*a* are inserted between the lower steam leakage prevention ribs 432*b* in a dual sealing fashion so as to effectively prevent steam from leaking outside.

The second nozzle housing 431 extends in the leftward and rightward direction of the door. The second nozzle housing 431 may include a plurality of second accommodating part outlets 437. Consequently, it is possible to supply steam throughout the washing space.

Meanwhile, the second steam accommodating part 433 may be configured such that the sectional area of the second steam accommodating part 433 gradually decreases as the second steam accommodating part 433 becomes more distant from the second accommodating part inlet 435. As the second steam accommodating part 433 becomes more distant from the second accommodating part inlet 435, the pressure of the steam in the second steam accommodating part 433 is lowered. As a result, the pressure of the steam discharged from the second accommodating part outlets 437 may be lowered. The second steam accommodating part 433 may be configured as described above in order to solve this problem.

That is, the second steam accommodating part 433 is configured such that the sectional area of the second steam accommodating part 433 gradually decreases as the second steam accommodating part 433 becomes more distant from the second accommodating part inlet 435 such that the pressure of the steam discharged from the second accommodating part outlets 437 is uniform.

Meanwhile, the second steam nozzle 43 may be spaced apart from the rear 27 of the tub 2. This structure is provided to prevent foreign matter removed from the objects from accumulating between the second steam nozzle 43 and the rear 27 of the tub 2 while falling along the rear 27 of the tub 2.

Furthermore, as shown in FIG. 11, the second steam nozzle 43 according to the present invention may further include foreign matter blocking ribs 438 for maintaining the distance between the second steam nozzle 43 and the rear 27 of the tub 2 at a predetermined distance or more.

The foreign matter blocking ribs 438 may protrude from the rear of the second steam nozzle 43, i.e. the second lower nozzle housing 431*b*. The foreign matter blocking ribs 438 may extend in the upward and downward direction to maintain the distance between the second steam nozzle 43 and the tub 2 and to guide the flow of wash water therebetween. Consequently, the distance between the second steam nozzle 43 and the rear 27 of the tub 2 is maintained despite vibration of the pump 8 and vibration of the tub 2.

Meanwhile, referring back to FIG. 8, the second steam path 45 is defined in the tub 2. The second steam path 45 penetrates the bottom of the tub 2. Specifically, one side of the second steam path 45 is connected to the second nozzle insertion part 436 of the second steam nozzle 43, which is provided in the tub 2, and the other side of the second steam path 45 extends through the bottom 28 of the tub 2.

In this case, a second connection path 46 is provided under the tub 2 such that the second connection path 46 connects the second steam path 45 to the steam source. That is, the in-tub section of the path for supplying steam from the steam source to the second steam nozzle 43 is defined as the second steam path 45, and the out-of-tub section of the path is defined as the second connection path 46.

As previously described, one selected from among the steam generator, the sump heater, which is provided in the sump 3, and the pump heater 83, which is provided in the pump 8, may be used as the steam source.

In the case in which the pump heater 83, provided in the pump 8, is used as the steam source, the second connection path 46 may be connected to the steam discharge port 843, which is provided in the first chamber C1 of the pump 8. Alternatively, the second connection path 46 may be connected to a path that diverges from the first steam path 44. In this case, the divergent path may be provided with a switch valve (not shown) for opening and closing the first steam path 44 and the second connection path 46. As a result, it is possible to adjust the amount of steam that is supplied to the first steam path 44 and the second connection path 46

The second connection path 46 is connected to the pump 8 and to the second steam path 45, which extends through the bottom 28 of the tub 2. Meanwhile, since the second connection path 46 is provided outside the tub 2, steam may be cooled due to heat exchange between the steam and external air while the steam flows along the second connection path 46. In this case, some of the steam flowing along the second connection path 46 may be condensed or frozen. As a result, the steam spray performance of the second steam nozzle 43 may be lowered. In order to solve this problem, it is necessary to minimize the length of the second connection path 46. Consequently, the length of the second steam path 45 may be greater than the length of the second connection path 46 so as to minimize the length of the second connection path 46.

FIG. 12 is a view showing a back pressure prevention unit for the steam nozzle provided in the dishwasher according to the present invention. FIG. 13 is a view showing a back pressure prevention unit for the steam path provided in the dishwasher according to the present invention. FIGS. 14 and 15 are views showing the back pressure prevention unit of the present invention.

Hereinafter, a back pressure prevention unit of the present invention will be described.

The dishwasher according to the present invention may further include a back pressure prevention unit for preventing the introduction of external air into the sump 3 or the pump 8.

In the case in which the first steam path 44 or the second steam path 45 is connected to the sump 3 or the pump 8, negative pressure is generated in the sump 3 or the pump 8 when the pump 8 is driven to spray wash water into the tub 2. Consequently, external air may be introduced into the sump 3 or the pump 8 through the first steam path 44 or the second steam path 45.

In this case, the pressure of wash water sprayed through the spray arms 711 and 713 may be lowered, or sufficient wash water may not be sprayed through the spray arms 711 and 713. In addition, the air may collide with the impeller 85, which is provided in the pump 8, whereby noise may be generated.

In order to solve these problems, the back pressure prevention unit may include a check valve 47. In the case in which steam generated by the pump 8 is supplied to the first steam path 44 or the second steam path 45, the check valve 47 may open the steam path. In the case in which the pump 8 is driven (i.e. when the impeller 85 is driven) to spray wash water into the tub 2, the check valve 47 may close the steam path.

As shown in FIG. 12, the check valve 47 may be provided in the first steam nozzle 42 or the second steam nozzle 43. Alternatively, as shown in FIG. 13, the check valve 47 may be provided in the first steam path 44 or the second steam path 45.

First, a check valve that is equally applicable to the steam nozzle and the steam path will be described.

Referring to FIGS. 12 and 13, the check valve 47 may include a first partition wall 471, having therein a steam path hole 4711 through which steam is discharged, and a back pressure prevention plate 4713 for opening and closing the steam path hole 4711. The back pressure prevention plate 4713 opens the steam path hole 4711 only when the pressure of steam is equal to or greater than a predetermined pressure.

Although not shown, the back pressure prevention plate 4713 may be configured to become thicker toward the center thereof such that, when the back pressure prevention plate 4713 is raised due to the pressure of the steam and then falls, the center of the back pressure prevention plate 4713 is aligned with the center of the steam path hole 4711 due to the back pressure of the pump 8.

In the case in which the check valve 47 is provided in the steam nozzle 42 or 43, the first partition wall 471 may constitute the nozzle housing 421 or 431 of the steam nozzle 42 or 43, and the steam path hole 4711 may constitute the accommodating part inlet 425 or 435.

Alternatively, in the case in which the check valve 47 is provided in the steam path 44 or 45, the first partition wall 471 may close the first steam path 44 or the second steam path 45, and steam may be discharged through the steam path hole 4711.

In addition, the check valve 47 may further include a prevention plate ring 4715 formed at one side of the back pressure prevention plate 4713 and a prevention plate fixing rib 4712 provided at the first partition wall 471 such that the prevention plate ring 4715 is fitted onto the prevention plate fixing rib 4712 to limit the movement of the back pressure prevention plate 4713.

Meanwhile, as shown in FIG. 14, the check valve 47 of the present invention may further include separation prevention ribs 4716 provided so as to be spaced apart from the outer circumferential surface of the back pressure prevention plate 4713 to prevent the back pressure prevention plate 4713 from being separated in the leftward and rightward direction.

Consequently, the separation prevention ribs 4716 may prevent the leftward or rightward movement of the back pressure prevention plate 4713, thereby preventing the steam path hole 4711 from becoming unable to close.

The separation prevention rib 4716 may be provided on the first partition wall 471 (see FIG. 14) or a second partition wall 473, which is opposite the first partition wall 471 (see FIG. 15).

In addition, as shown in FIG. 15, the check valve 47 of the present invention may further include stoppers 4731 provided above the back pressure prevention plate 4713 so as to be spaced apart from each other. The stoppers 4731 may collide with the back pressure prevention plate 4713, raised by the pressure of steam, to provide restoring force to the back pressure prevention plate 4713. The stoppers 4731 may be made of an elastic material, such as rubber.

That is, when the back pressure prevention plate 4713 is raised by the pressure of steam, the back pressure prevention plate 4713 may collide with the stoppers 4731. At this time, the elastic force of the stoppers 4731 acts as restoring force. As a result, the back pressure prevention plate 4713 may return to the original position thereof.

In addition, the check valve 47 of the present invention may further include a contact prevention rib 4732 provided on the second partition wall 473, which is opposite the first partition wall 471. The contact prevention rib 4732 may prevent the back pressure prevention plate 4713 from clinging to the second partition wall 473 due to a hydroplaning phenomenon.

The contact prevention rib 4732 may be provided perpendicularly to a rotary shaft of the back pressure prevention plate 4713. The contact prevention rib 4732 may include a plurality of contact prevention rib parts arranged at intervals. In addition, the contact prevention rib 4732 (or grooves between the contact prevention rib parts) may be inclined such that condensed steam water can flow along the inclined surface of the contact prevention rib 4732, thereby preventing the occurrence of a hydroplaning phenomenon on the second partition wall 473.

MODE FOR INVENTION

Various embodiments have been described in the best mode for carrying out the invention.

INDUSTRIAL APPLICABILITY

The present invention has the effect of providing a dishwasher that is capable of spraying steam to objects to be washed from the front or the rear of a tub.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A dishwasher comprising:

a cabinet having an opening;

a tub provided in the cabinet, the tub accommodating objects for washing;

a spray arm for spraying wash water to the objects;

a sump for storing wash water;

a door for opening and closing the opening and including a front panel defining a front surface of the dishwasher and a rear panel defining an inner surface of the door, wherein the rear panel includes an inclined surface formed at a lower portion of the rear panel and having an upper portion inclined to an outer side of the tub and a steam nozzle insertion hole formed in the inclined surface;

a first steam nozzle mounted at an outer surface of the inclined surface of the rear panel to the steam nozzle insertion hole for spraying steam;

a first steam path located outside the tub, and connected to the first steam nozzle, the first steam path supplying steam to the first steam nozzle; and a steam guide provided at an inner surface of the inclined surface of the rear panel and connected to the first steam nozzle for changing the direction of the first steam path of the steam supplied from the first steam path upward to supply the steam to the first steam nozzle, wherein a predetermined section of the first steam path is provided substantially parallel to a rotary shaft of the door and connected to the first steam nozzle, wherein the first steam nozzle is provided at an outer surface of the rear panel of the door to spray steam to a position located upward obliquely of the objects, and wherein the steam guide has one side connected to the first steam nozzle at an inside of the door and the other side connected to the first steam path an outside of the door.

2. The dishwasher according to claim 1, wherein the first steam nozzle comprises:

a nozzle housing having a steam accommodating part for temporarily storing steam therein;

an accommodating part inlet provided in the nozzle housing, the accommodating part inlet supplying steam to the steam accommodating part; and a plurality of accommodating part outlets provided in the nozzle housing, the plurality of accommodating part outlets spraying the steam stored in the steam accommodating part to the objects.

3. The dishwasher according to claim 2, wherein a sectional area of the steam accommodating part gradually decreases as the steam accommodating part becomes more distant from the accommodating part inlet.

4. The dishwasher according to claim 1, wherein the first steam path receives steam from a steam generator provided under the tub.

5. The dishwasher according to claim 1, further comprising:

a sump heater provided in the sump, wherein the first steam path receives steam from the sump.

6. The dishwasher according to claim 1, further comprising:

a pump for supplying the wash water stored in the sump to the spray arm, wherein the pump includes a pump heater, and the first steam path receives steam from the pump.

7. The dishwasher according to claim 6, further comprising a back pressure prevention unit for preventing external air from being introduced into the pump.

8. The dishwasher according to claim 7, wherein the back pressure prevention unit comprises a check valve provided in the first steam nozzle or in the first steam path.

9. The dishwasher according to claim 8, wherein the check valve comprises:

a first partition wall having a steam path hole, through which steam is discharged;

a back pressure prevention plate for opening and closing the steam path hole;

a prevention plate ring formed at one side of the back pressure prevention plate; and a fixing rib provided at the first partition wall, the fixing rib being coupled to the prevention plate ring to limit a movement of the back pressure prevention plate.

10. The dishwasher according to claim 9, wherein the check valve further comprises separation prevention ribs provided spaced apart from an outer circumferential surface of the back pressure prevention plate, the separation prevention ribs preventing the back pressure prevention plate from being separated in a leftward and rightward direction.

11. The dishwasher according to claim 9, wherein the check valve further comprises stoppers provided above the back pressure prevention plate so as to be spaced apart from each other, the stoppers colliding with the back pressure prevention plate, raised by pressure of steam, to provide restoring force to the back pressure prevention plate.

12. The dishwasher according to claim 9, wherein the check valve further comprises a contact prevention rib provided on a second partition wall which is opposite the first partition wall, the contact prevention rib preventing the back pressure prevention plate from clinging to the second partition wall due to a hydroplaning phenomenon.

13. The dishwasher according to claim 1, further comprising:

a second steam nozzle provided at a rear surface of the tub, the second steam nozzle spraying steam to the objects;

a second steam path connected to the second steam nozzle, the second steam path supplying steam to the second steam nozzle, and the second steam path penetrating a bottom surface of the tub; and a second connection path connecting the second steam path to a steam source.

14. The dishwasher according to claim 13, wherein a length of the second steam path is greater than a length of the second connection path.

15. The dishwasher according to claim 1, further comprising:

a second steam nozzle spaced apart from a rear surface of the tub, the second steam nozzle spraying steam to the objects;

a second steam path connected to the second steam nozzle, the second steam path supplying steam to the second steam nozzle, and the second steam path penetrating a bottom surface of the tub; and a second connection path connecting the second steam path to a steam source.

16. The dishwasher according to claim 15, wherein the second steam nozzle comprises a foreign matter blocking rib for maintaining a distance between the second steam nozzle and the rear surface of the tub at a predetermined distance or more.

* * * * *